US007148411B2

(12) United States Patent
Hsieh

(10) Patent No.: US 7,148,411 B2
(45) Date of Patent: Dec. 12, 2006

(54) ADJUSTABLE TUNING TUBE FOR A CLARINET

(76) Inventor: Wu Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 638 days.

(21) Appl. No.: 10/679,484

(22) Filed: Oct. 7, 2003

(65) Prior Publication Data

US 2005/0072290 A1 Apr. 7, 2005

(51) Int. Cl.
*G10D 9/00* (2006.01)

(52) U.S. Cl. ..... 84/386; 84/394

(58) Field of Classification Search ..... 84/386, 84/382, 381, 380 R, 394; D17/10, 11
See application file for complete search history.

(56) References Cited

U.S. PATENT DOCUMENTS 2,802,387 A * 8/1957 Bushnell ..... 84/386
5,249,499 A * 10/1993 Goldstein et al. ..... 84/386
5,291,817 A * 3/1994 Smith ..... 84/386
5,864,076 A * 1/1999 Eder ..... 84/382
6,054,644 A * 4/2000 Allen et al. ..... 84/382

* cited by examiner

*Primary Examiner*—Lincoln Donovan
*Assistant Examiner*—Jianchun Qin
(74) *Attorney, Agent, or Firm*—Bacon & Thomas, PLLC

(57) ABSTRACT

An adjustable tuning tube for a clarinet is composed of an outer tube and an inner tube. The outer tube has a first upper chamber, a lower chamber, and a middle portion between the first upper chamber and the lower chamber. A button is pivotally mounted in an arcuate slot defined at an outer periphery of the middle portion and has a finger formed at a first end thereof and extending in the outer tube, and multiple first teeth formed on the finger. The inner tube is received in the outer tube, and has multiple second teeth formed at an outer periphery thereof and matching the first teeth of the button.

5 Claims, 7 Drawing Sheets

ADJUSTABLE TUNING TUBE FOR A CLARINET

BACKGROUND OF THE INVENTION

1. Field of the Invention

The present invention relates to a wind instrument, and more particularly to a tuning tube for a clarinet.

2. Description of Related Art

With reference to FIGS. 9–10, a clarinet (60) has a top end (61) with a first cork (not numbered) mounted in the top end (61). A tuning tube (70) has a lower chamber (72) defined at a lower portion thereof and an upper chamber (71) defined at an upper portion thereof. The top end (61) of the clarinet (60) is received in the lower chamber (72).

An upper tube (80) has a lower end (81) with a second cork (not numbered) mounted in the lower end and received in the upper chamber (71) of the tuning tube (70). A mouthpiece (82) is mounted on a top end of the upper tube (80).

When a keynote of the clarinet (60) is sharp, the tuning tube (70) is pulled upwards to lower the pitch. When the keynote of the clarinet (60) is flat, the tuning tube (70) should be replaced with another tube (not shown) shorter than the tuning tube (70) to raise the pitch, which is a very inconvenient way to tune the clarinet (60).

Moreover, during pulling the tuning tube (80), the second cork on the upper tube (80) is easily damaged. The mouthpiece (82) needs to be adjusted after tuning, so the processing is very complex. Furthermore, there is a large space (62) between the tuning tube (70) and the top end (61), so condensed water etc will accumulate in the space (62) and airflow through the clarinet (60) will become incontrollable, which is not good for the performance.

Therefore, the invention provides an adjustable tuning tube for a clarinet to mitigate or obviate the aforementioned problems.

SUMMARY OF THE INVENTION

The main objective of the present invention is to provide a tuning tube for a clarinet which is easy to be adjusted and will not accumulate condensed water from a performer's breath.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
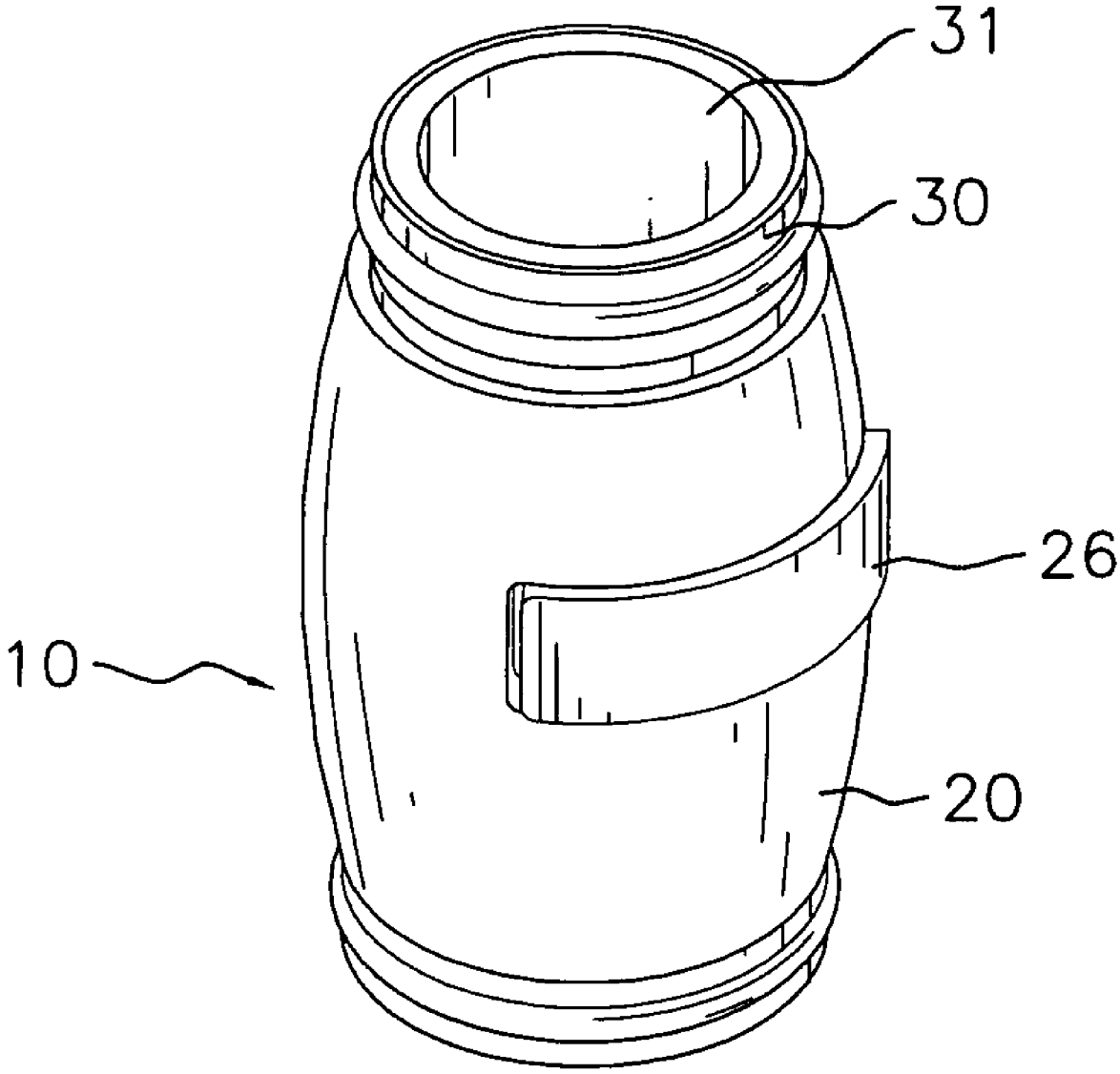
FIG. 1 is a perspective view of an adjustable tuning tube for a clarinet in accordance with the present invention.
Figure 2:
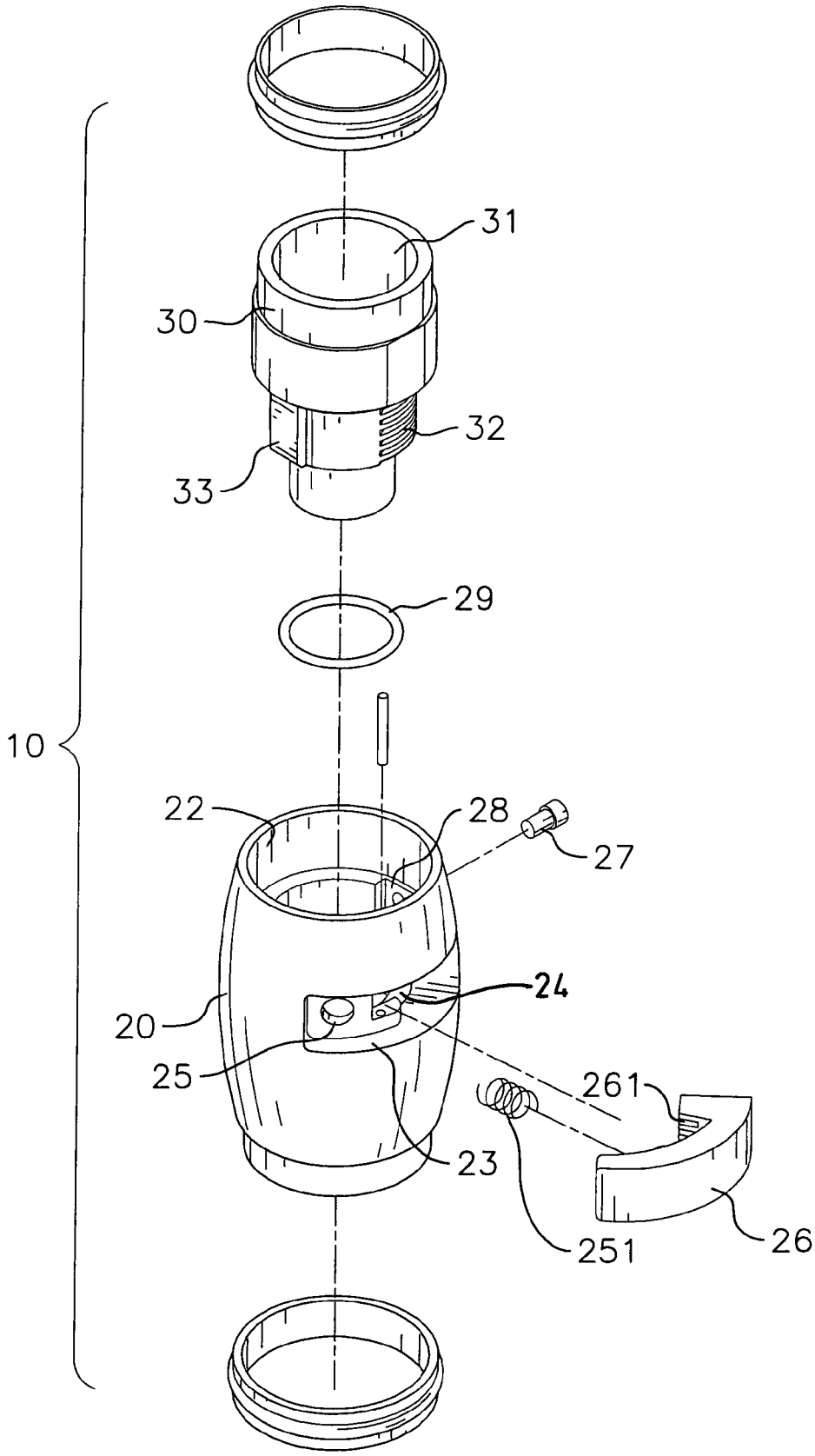
FIG. 2 is an exploded perspective front view of the adjustable tuning tube in FIG. 1.
Figure 3:
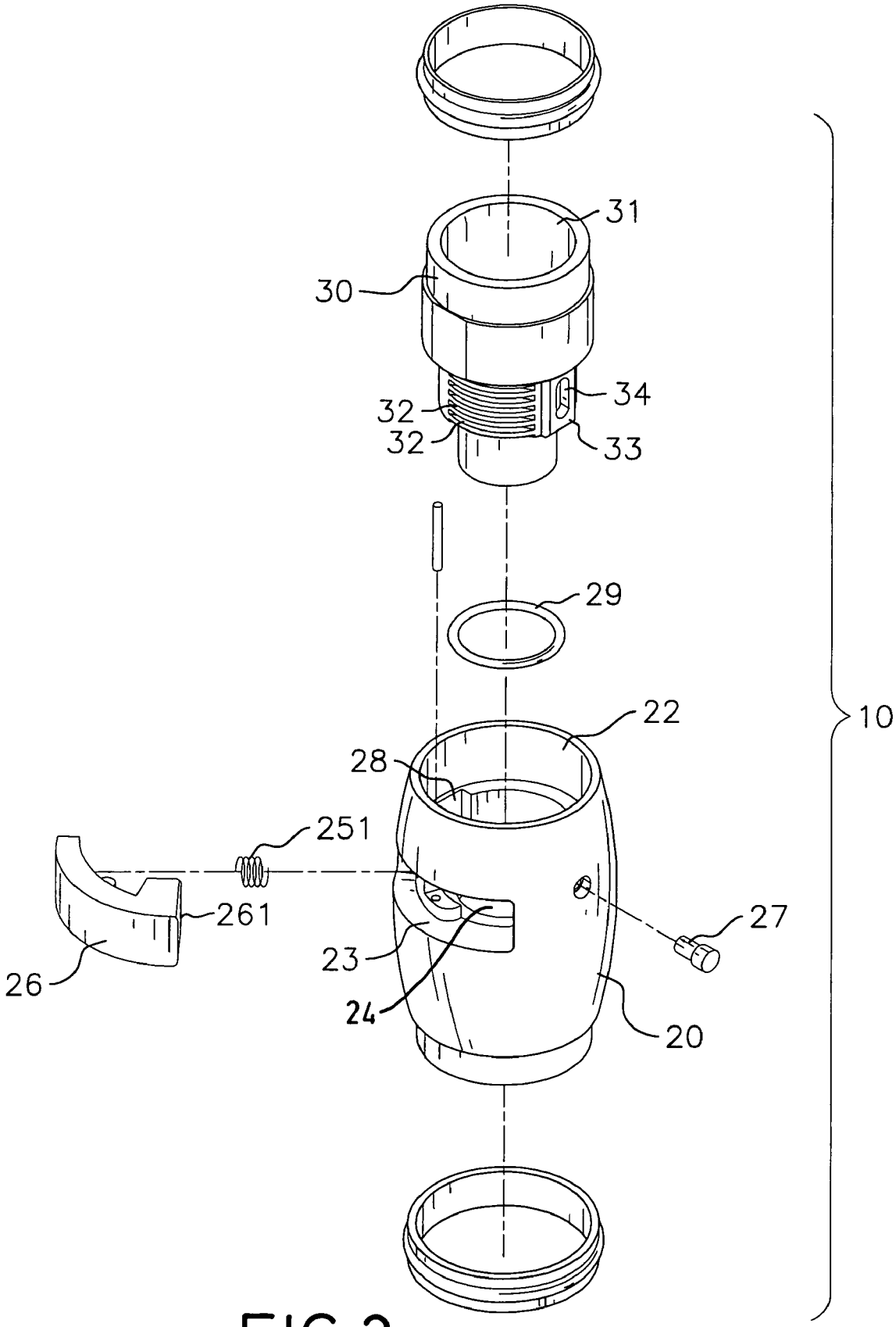
FIG. 3 is an exploded perspective back view of the adjustable tuning tube.
Figure 4:
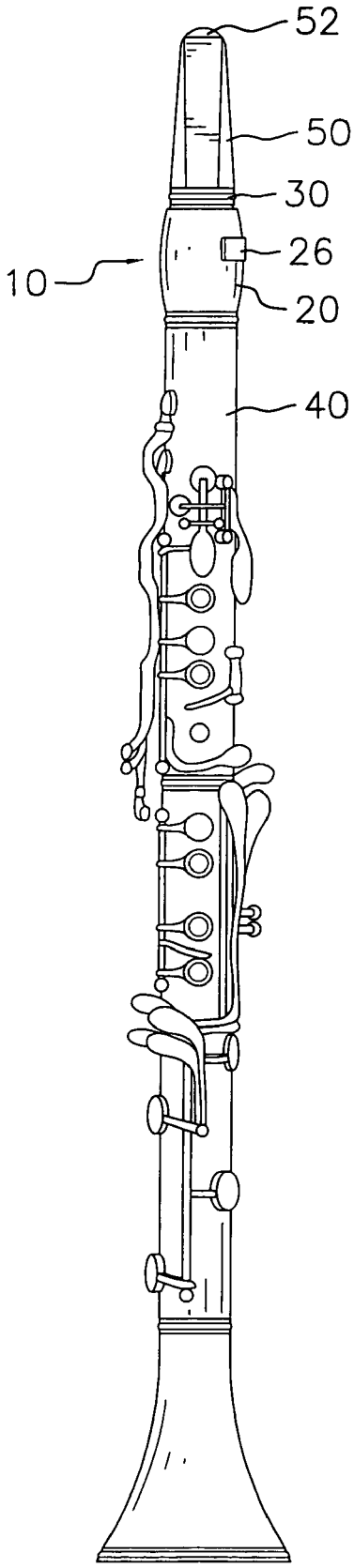
FIG. 4 is a front view of a clarinet assembled with the adjustable tuning tube of the invention.
Figure 5:
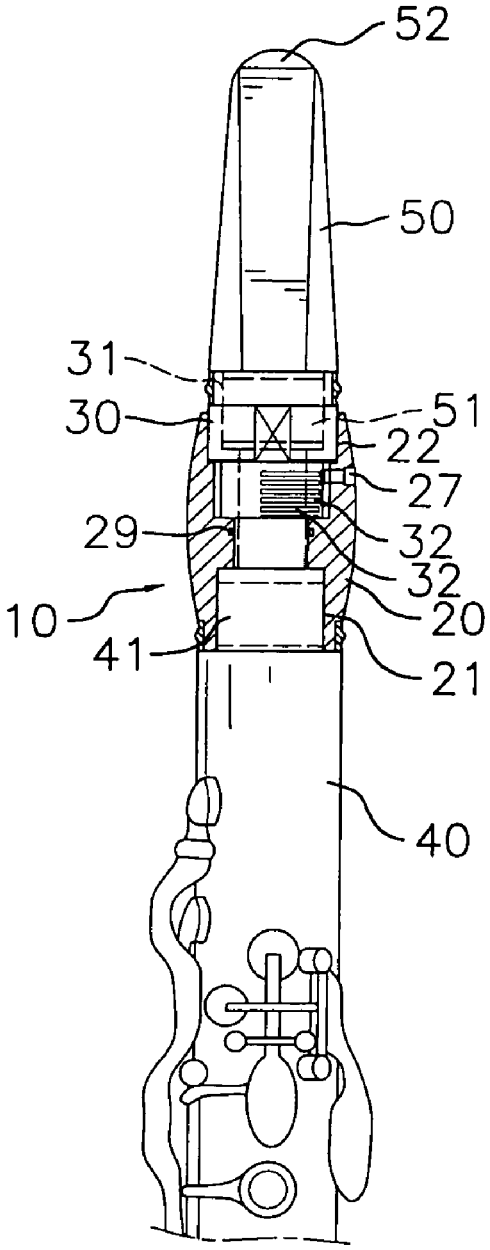
FIG. 5 is a partially sectional front view of the adjustable tuning tube mounted on the clarinet.

With reference to FIGS. 1, 2, 3, and 5, an adjustable tuning tube (10) for a clarinet in accordance with the invention is composed of an outer tube (20) and an inner tube (30) received in the outer tube (20).

The outer tube (20) has a lower chamber (21) defined at a lower portion thereof, a first upper chamber (22) defined at an upper portion thereof, and a middle portion (not numbered) between the lower chamber (21) and the first upper chamber (22). An arcuate slot (23) is transversally defined at an outer periphery of the middle portion of the outer tube (20). An opening (24) is defined in a face defining the arcuate slot (23) and through the outer tube (20). The face defining the arcuate slot (23) further has a recess (25) defined beside the opening (24). A resilient member (251) is mounted in the recess (25).

A button (26) has a middle part pivotally mounted in the arcuate slot (23), a finger (not numbered) formed at a first end thereof and extending through the opening (24) into the outer tube (20), and a second end (not numbered) abutting the resilient member (251). Multiple first teeth (261) are formed at an inner wall of the finger of the button (26).

Two sliding grooves (28) are longitudinally defined in an inner wall of the middle portion of the outer tube (20) and at two diametrically opposite sides. A pin (27) is radially inserted through one of the sliding grooves (28) in the outer tube (20).

The inner tube (30) has an upper part received in the upper chamber (22), a lower part (not numbered) received in the middle portion of the outer tube (20). An O-ring (29) is provided between the middle portion of the outer tube (20) and the lower part of the inner tube (30). A second upper chamber (31) is defined at the upper part of the inner tube (30). Multiple second teeth (32) are formed at the lower part of the inner tube (30) and match the first teeth (261). The lower part of the inner tube (30) further has two ridges (33) respectively formed at two diametrically opposite sides of an outer periphery thereof and received in the grooves (28). An elongated slot (34) is longitudinally defined in one of the ridges (33) and the pin (27) is inserted in the elongated slot (34). Thus, the inner tube (30) is longitudinally movable about the outer tube (20) by the ridges (33) sliding along the grooves (28) but not freely disengaged from the outer tube (20) by the pin (27).

With reference to FIGS. 1, 4, 5, and 6, when the adjustable tuning tube (10) is assembled on a clarinet (40), a top end (41) with a first cork (not numbered) of the clarinet (40) is received in the lower chamber (21) of the outer tube (20), and a lower end (51) with a second cork (not numbered) of an upper tube (50) is received in the second upper chamber (31) of the inner tube (30). The upper tube (50) has a mouthpiece (52) provided thereon.

Figure 7:
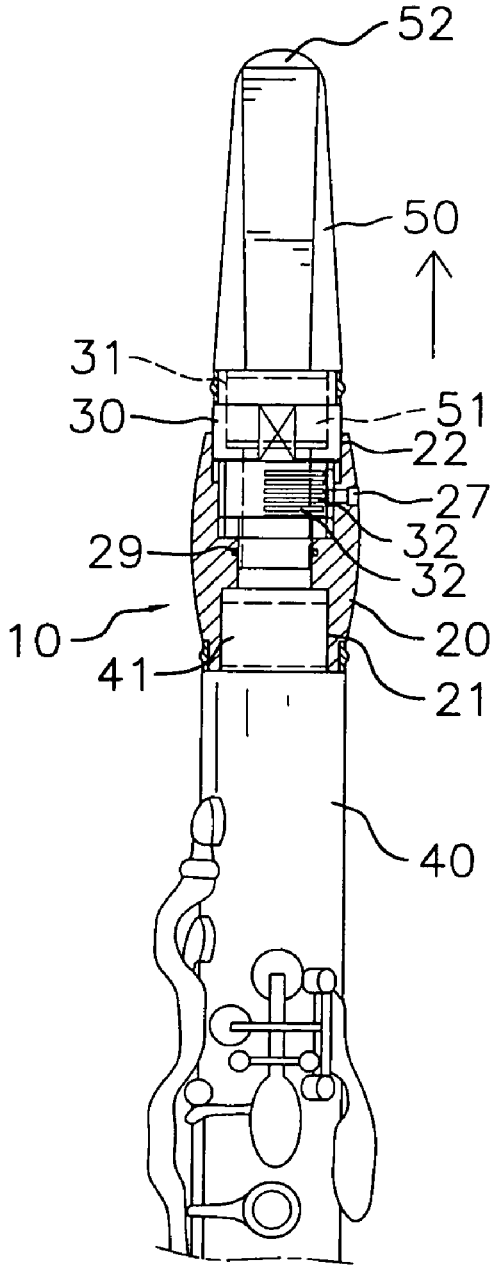
FIG. 7 is a partially sectional front view of the adjustable tuning tube in adjustment.
Figure 6:
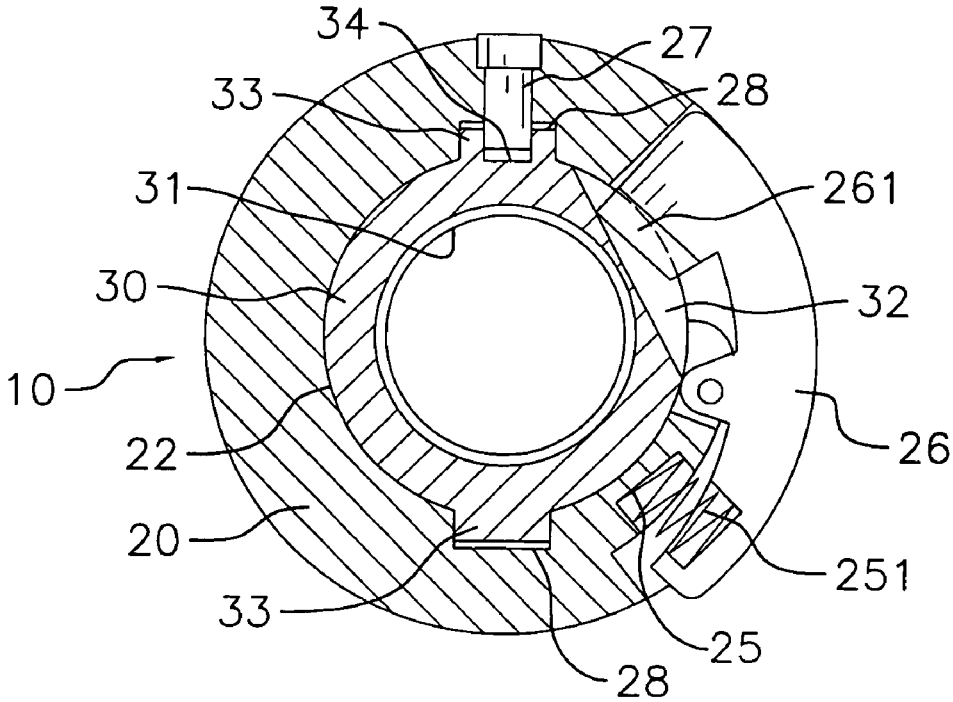
FIG. 6 is a cross sectional view of FIG. 5.
Figure 8:
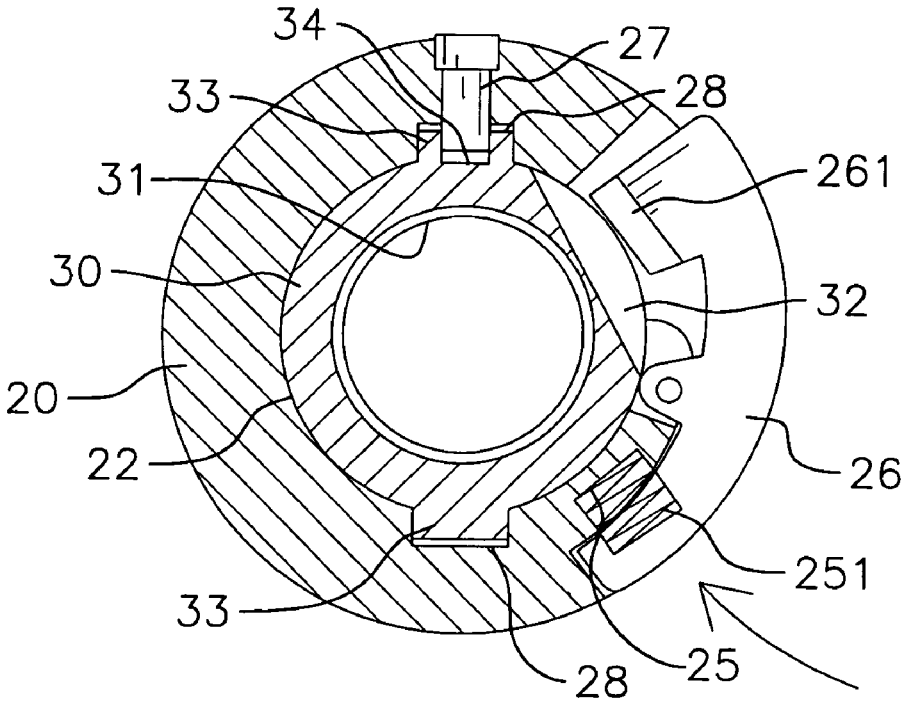
FIG. 8 is a cross sectional view of FIG. 7.
Figure 9:
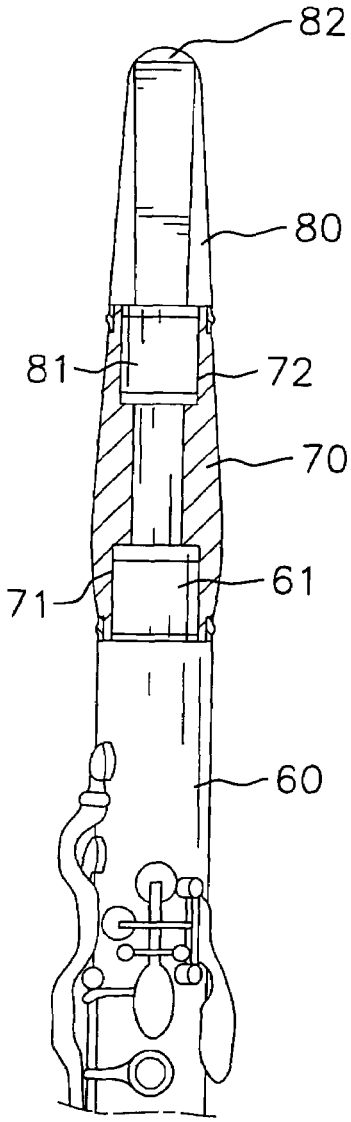
FIG.9 PRIOR ART
FIG. 9 is a partially sectional view of a clarinet assembled with a conventional tuning tube.
Figure 10:
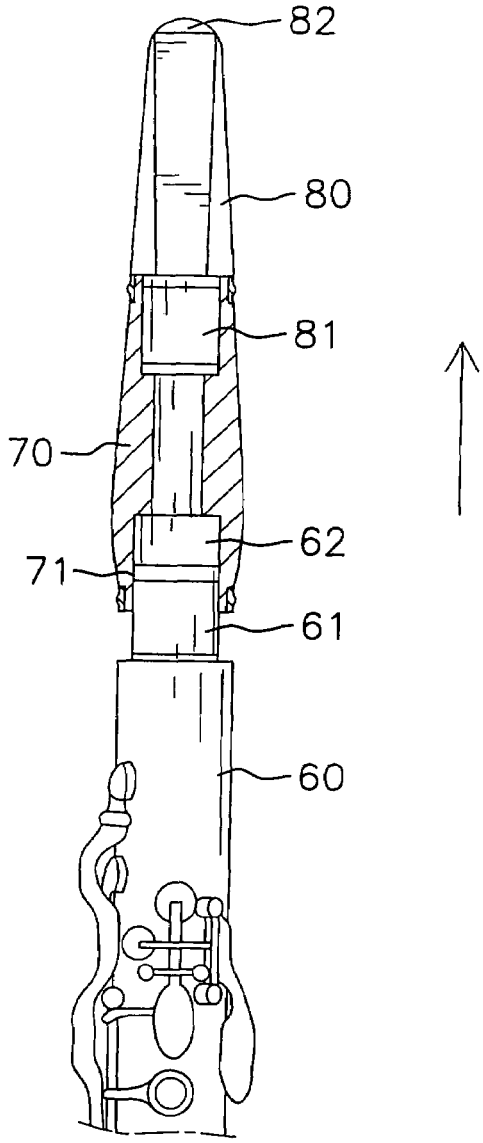
FIG.10 PRIOR ART
FIG. 10 is a partially sectional view of the conventional tuning tube being pulled upwards.

In adjusting, as shown in FIGS. 7 and 8, the button (26) is pressed at the second end thereof to disengage the first teeth (261) from the second teeth (32), so the inner tube (30) can be moved upwards or downwards about the outer tube (20) to lower or raise the pitch. Thereafter, the button (26) is released, and the first teeth (261) are engaged with the selected second teeth (32) to fix the inner tube (30) in the outer tube (20).

Therefore, according to the present invention, it is very easy for a user to tune the clarinet with various pitches. In this embodiment, a maximum tunable pitch can be above a quarter of halftone. Moreover, there is a little space between the outer tube (20) and the inner tube (30), so the condensed water will not accumulate in the space and the user can easily control airflow through the clarinet (40) for performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable tuning tube for a clarinet comprising:

an outer tube having a first upper chamber defined at an upper portion of the outer tube, a lower chamber defined at a lower portion thereof, a middle portion between the first upper chamber and the lower chamber, an arcuate slot transversally defined at an outer periphery of the middle portion of the outer tube, an opening defined in a face defining the arcuate slot and through the outer tube, a button pivotally mounted in the arcuate slot and having a finger formed at a first end of the button and extending in the outer tube through the opening, and multiple first teeth formed at an inner wall of the finger; and an inner tube having an upper part received in the first upper chamber of the outer tube, a lower part received in the middle portion of the outer tube, a second upper chamber defined at the upper part of the inner tube, and multiple second teeth formed at the lower part of the inner tube and matching the first teeth of the button.

2. The adjustable tuning tube as claimed in claim 1, wherein the face defining the arcuate slot further has a recess defined beside the opening, and a resilient member mounted in the recess and abutting a second end of the button.

3. The adjustable tuning tube as claimed in claim 1, wherein the outer tube has at least one groove longitudinally defined in an inner wall of the middle portion of the outer tube; and the inner tube has at least one ridge longitudinally formed at the outer periphery of the lower part and received in the groove.

4. The adjustable tuning tube as claimed in claim 3, wherein the inner tube has an elongated slot defined in the ridge, and the outer tube has a pin radially inserted through the groove and into the elongated slot.

5. The adjustable tuning tube as claimed in claim 1 further comprising an O-ring provided between the middle portion of the outer tube and the lower part of the inner tube.

* * * * *